US007495503B2

(12) United States Patent
Chen et al.

(10) Patent No.: US 7,495,503 B2
(45) Date of Patent: Feb. 24, 2009

(54) CURRENT BIASING CIRCUIT

(75) Inventors: Kai-Ji Chen, Tainan County (TW); Ching-Wei Hsueh, Tainan County (TW)

(73) Assignee: Himax Analogic, Inc., Tainan County (TW)

( * ) Notice: Subject to any disclaimer, the term of this patent is extended or adjusted under 35 U.S.C. 154(b) by 0 days.

(21) Appl. No.: 11/747,917

(22) Filed: May 14, 2007

(65) Prior Publication Data

US 2008/0284502 A1 Nov. 20, 2008

(51) Int. Cl.
*G05F 1/10* (2006.01)

(52) U.S. Cl. ..... 327/538; 327/513

(58) Field of Classification Search ..... 327/512, 327/513, 538, 539, 543
See application file for complete search history.

(56) References Cited

U.S. PATENT DOCUMENTS 4,769,589 A * 9/1988 Rosenthal ..... 323/313
5,448,103 A * 9/1995 de Wit ..... 257/536
6,342,781 B1 * 1/2002 Laraia ..... 323/313
6,351,111 B1 * 2/2002 Laraia ..... 323/315
6,724,244 B2 * 4/2004 Wu ..... 327/543
6,759,893 B2 * 7/2004 Gailhard et al. ..... 327/513
2003/0132796 A1 7/2003 Gailhard et al.

* cited by examiner

*Primary Examiner*—Jeffrey S Zweizig
(74) *Attorney, Agent, or Firm*—Jianq Chyun IP Office

(57) ABSTRACT

A current biasing circuit is provided, which is designed to suppress reference current drift caused by temperature variation with a low overall temperature coefficient of a constant-voltage circuit and at least one resistor. The constant-voltage circuit comprises a diode and/or a diode-connected transistor. This current biasing circuit is based on a current mirror architecture, is easy to implement, and is a relatively temperature-independent current source.

18 Claims, 5 Drawing Sheets

CURRENT BIASING CIRCUIT

BACKGROUND OF THE INVENTION

1. Field of the Invention

The present invention relates to a current biasing circuit. More particularly, the present invention relates to a current biasing circuit based on a current mirror architecture.

2. Description of the Related Art

An integrated circuit (IC) comprises many component blocks. Such blocks may need controlled current sources to supply stable and constant currents. For example, an operational amplifier may need a constant current of 1 mA.

FIG. 1 is a schematic diagram showing a conventional current biasing circuit 100. The circuit 100 is based on a current mirror architecture and supplys constant currents to component blocks of an IC. The current $I_{11}$ is equal to the current $I_{12}$. The ratio among the currents $I_{12}$, $I_{13}$ and $I_{14}$ is decided by the aspect ratios of the metal oxide semiconductor field effect transistors (MOSFET) $M_{14}$, $M_{15}$ and $M_{16}$.

The variance of the current $I_{12}$ is proportional to the square power of the resistance variance of the resistor Rs because of the current-voltage characteristics of the MOSFET $M_{12}$ operating in the saturation region. Therefore the reference current $I_{12}$ is very sensitive to the resistance variation of the resistor Rs. Results of a computer simulation show that there is a 70% current variance when the temperature varies from −25° C. to 120° C. The reference current $I_{12}$ may be driven out of specifications due to such a current drift, thus complicating circuit design.

FIG. 2 is a schematic diagram showing another conventional current biasing circuit 200. The bipolar junction transistor (BJT) $Q_2$ counteracts the temperature-dependent resistance variation of the resistor $R_{N2}$. The currents $I_{21}$ is equal to the current $I_{22}$, which means the gate-to-source voltage of the MOSFET $M_{21}$ is equal to the gate-to-source voltage of the MOSFET $M_{22}$. The gate terminals of the MOSFETs $M_{21}$ and $M_{22}$ are connected together. The BJT $Q_2$ and the resistor $R_{N2}$ are connected to the common voltage source VSS. Therefore the voltage across the diode-connected BJT $Q_2$ (the base-to-emitter voltage of $Q_2$) is equal to the voltage across the resistor $R_{N2}$. The base-to-emitter voltage of the BJT $Q_2$ is constant. The reference current $I_{22}$ is equal to the constant base-to-emitter voltage divided by the resistance of the resistor $R_{N2}$. Since both the base-to-emitter voltage of $Q_2$ and the resistance of the resistor $R_{N2}$ have negative temperature coefficients, the current drift of the circuit 200 caused by temperature variance is much slighter than that of the circuit 100.

However, the temperature coefficient of the base-to-emitter voltage of $Q_2$ is more negative than that of the resistance of the resistor $R_{N2}$. The base-to-emitter voltage of the BJT $Q_2$ drops faster than the resistance of the resistor RN2 when the temperature rises. The current drift is still severe when there is a wide variance in temperature. Results of a computer simulation show that there is a 22% current variance when the temperature varies from −25° C. to 120° C.

SUMMARY OF THE INVENTION

Accordingly, the present invention is directed to a current biasing circuit which is designed to suppress reference current drift caused by temperature variation. This current biasing circuit is easy to implement and is a substantially temperature-independent current source for IC component blocks.

According to an embodiment of the present invention, a current biasing circuit is provided. The current biasing circuit comprises a first circuit, a second circuit, a third circuit and a second resistor. The first circuit draws a first current from a first voltage source, wherein the first circuit comprises a plurality of transistors coupled in series. The second circuit draws a second current from the first voltage source, wherein the second circuit comprises a plurality of transistors coupled in series. The gate terminal of each transistor of the first circuit is coupled to the gate terminal of one of the transistors of the second circuit. The first current is substantially equal to the second current. The third circuit is coupled between the first circuit and a second voltage source. The third circuit receives the first current from the first circuit. The third circuit comprises a first resistor and a constant-voltage circuit coupled in series. The first resistor has a positive temperature coefficient. The voltage across the constant-voltage circuit is substantially a predetermined constant value. The second resistor is coupled between the second circuit and the second voltage source. The second resistor receives the second current from the second circuit. The second resistor has a negative temperature coefficient.

According to another embodiment of the present invention, a current biasing circuit is provided. The current biasing circuit comprises a first circuit, a second circuit, a third circuit and a constant-voltage circuit. The first circuit draws a first current from a first voltage source, wherein the first circuit comprises a plurality of transistors coupled in series. The second circuit draws a second current from the first voltage source, wherein the second circuit comprises a plurality of transistors coupled in series. The gate terminal of each transistor of the first circuit is coupled to the gate terminal of one of the transistors of the second circuit. The first current is substantially equal to the second current. The constant-voltage circuit is coupled between the first circuit and a second voltage source. The constant-voltage circuit receives the first current from the first circuit. The voltage across the constant-voltage circuit is substantially a predetermined constant value. The third circuit is coupled between the second circuit and the second voltage source. The third circuit receives the second current from the second circuit. The third circuit comprises a first resistor and a second resistor coupled in series, wherein the first resistor has a positive temperature coefficient and the second resistor has a negative temperature coefficient.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
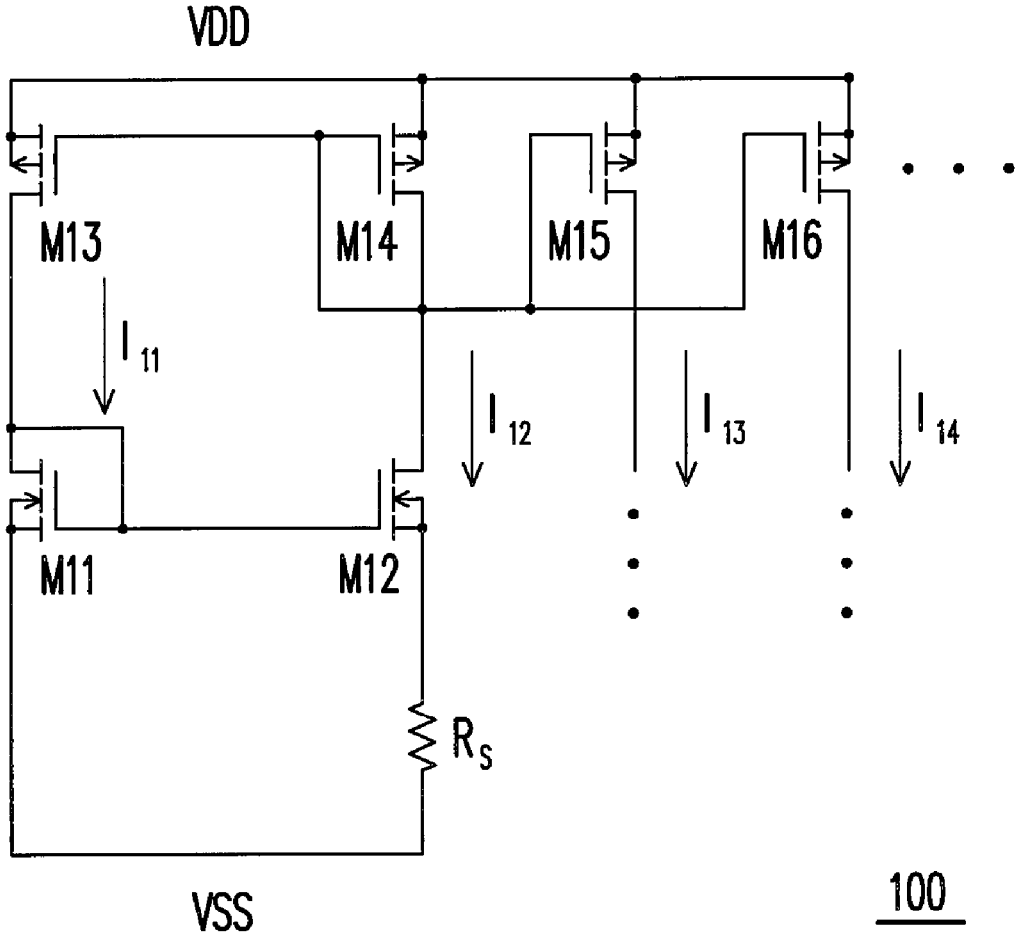
FIG. 1 (PRIOR ART)
FIG. 1 is a schematic diagram showing a conventional current biasing circuit.
Figure 2:
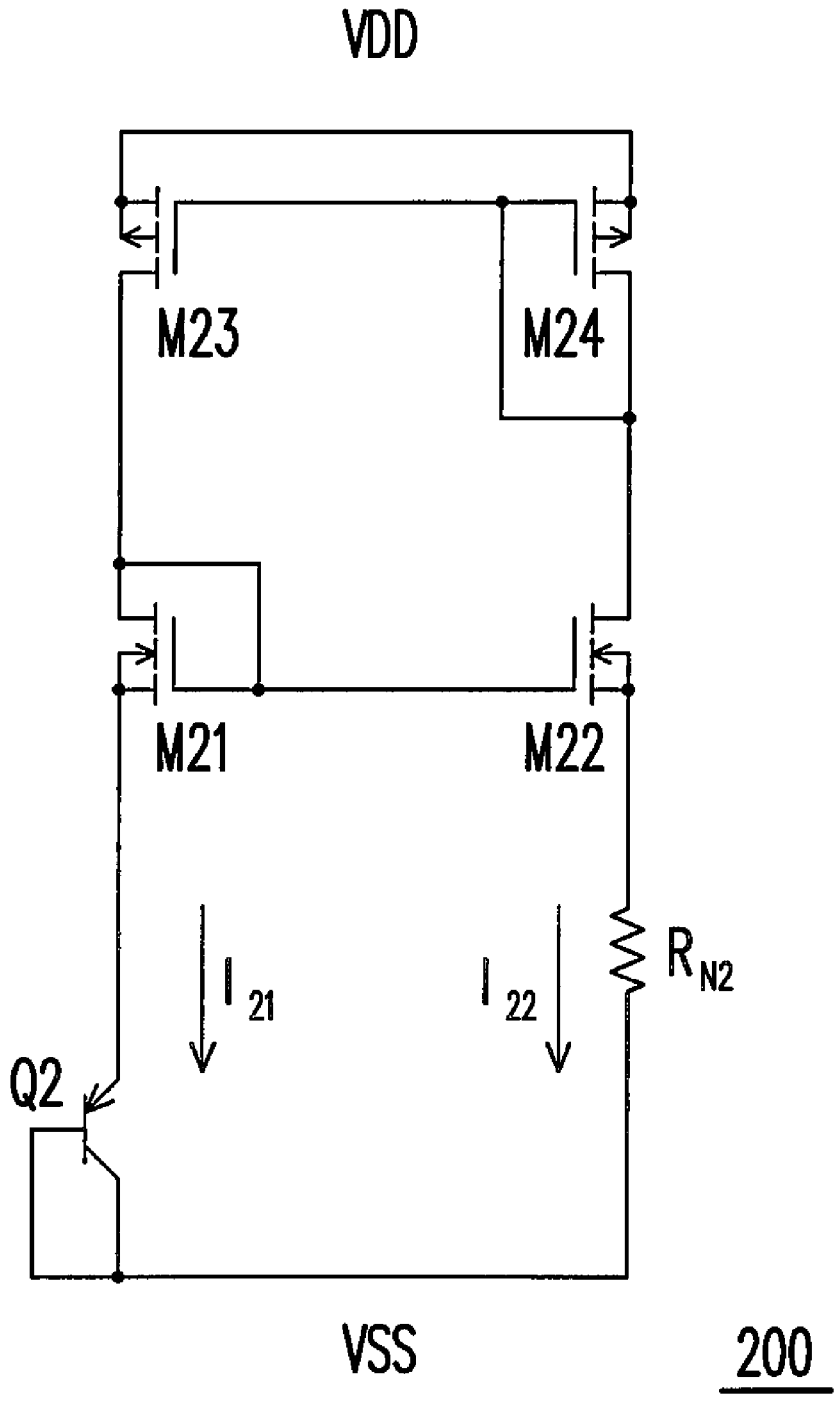
FIG. 2 (PRIOR ART)
FIG. 2 is a schematic diagram showing another conventional current biasing circuit.

Reference will now be made in detail to the present preferred embodiments of the invention, examples of which are illustrated in the accompanying drawings. Wherever possible, the same reference numbers are used in the drawings and the description to refer to the same or like parts.

Figure 3A:
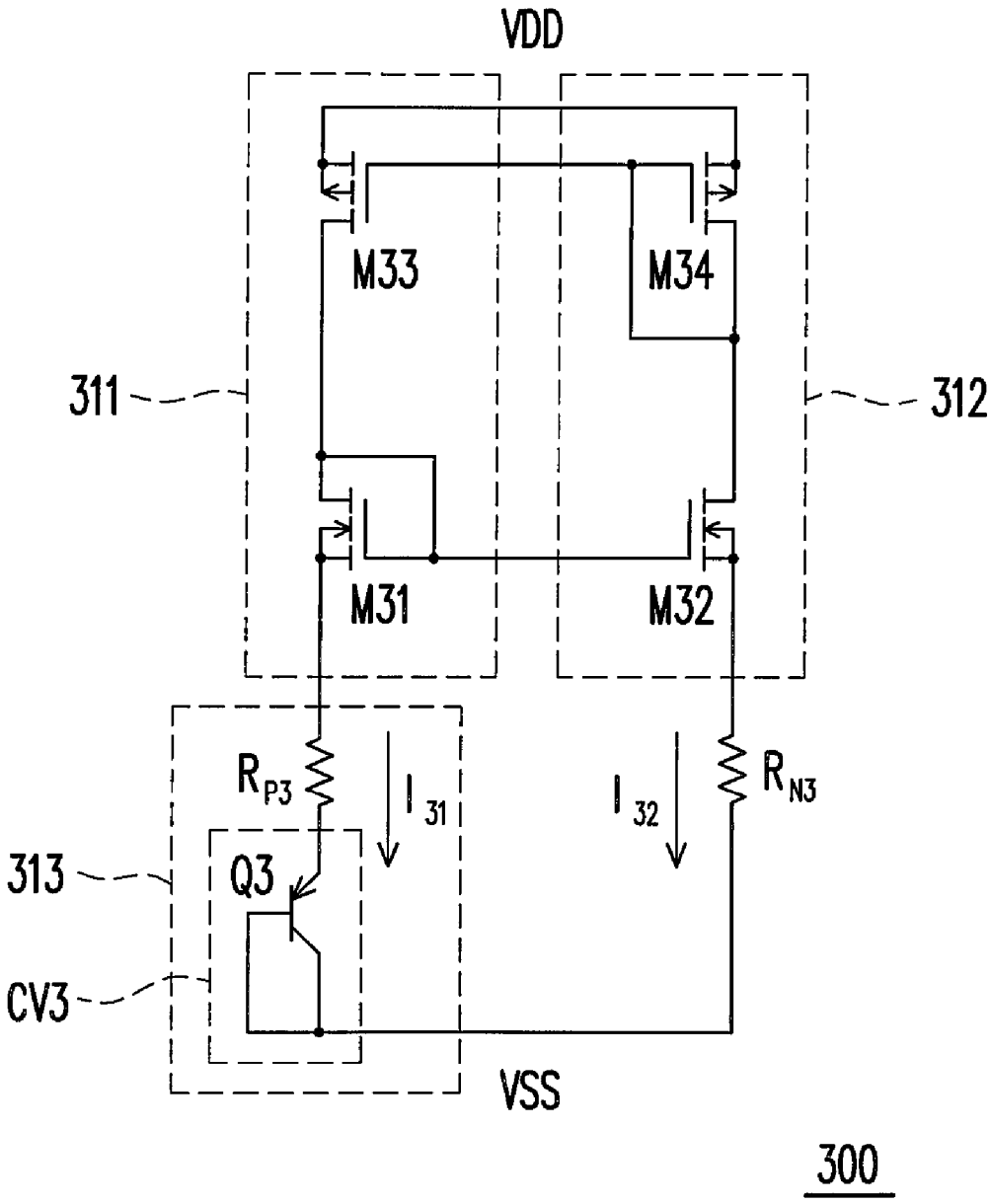
FIG. 3A, FIG. 3B and FIG. 4 are schematic diagrams showing current biasing circuits according to embodiments of the present invention.

FIG. 3A is a schematic diagram showing the current biasing circuit 300 according to an embodiment of the present invention. The current biasing circuit 300 includes the circuit 311, the circuit 312, the circuit 313 and the resistor $R_{N3}$. The current biasing circuit 300 is based on a current mirror architecture. The circuits 311 and 312 constitute the two current paths of a current mirror. The circuit 311 comprises the p-channel MOSFET (PMOS transistor) $M_{33}$ coupled to the voltage source VDD and the n-channel MOSFET (NMOS transistor) $M_{31}$ coupled between the PMOS transistor M33 and the circuit 313. The circuit 312 comprises the PMOS transistor $M_{34}$ coupled to the voltage source VDD and the NMOS transistor $M_{32}$ coupled between the PMOS transistor $M_{34}$ and the resistor $R_{N3}$. The NMOS transistor $M_{31}$ and the PMOS transistor $M_{34}$ are both diode-connected. The gate terminals of the PMOS transistors $M_{33}$ and $M_{34}$ are coupled, while the gate terminals of the NMOS transistors $M_{31}$ and $M_{32}$ are also coupled. The circuit 311 draws the current $I_{31}$ from the voltage source VDD. The circuit 312 draws the current $I_{32}$ from the voltage source VDD. The current $I_{31}$ is substantially equal to the current $I_{32}$ because of the current mirror architecture.

Since a current mirror may be formed using BJTs as well as using MOSFETs, the transistors of the circuits 311 and 312 may be replaced with BJTs.

The circuit 313 is coupled between the circuit 311 and the voltage source VSS. The circuit 313 receives the current $I_{31}$ from the circuit 311. The circuit 313 includes the resistor $R_{P3}$ and the constant-voltage circuit CV3 coupled in series. The resistor $R_{P3}$ has a positive temperature coefficient. The resistor $R_{N3}$ is coupled between the circuit 312 and the voltage source VSS. The resistor $R_{N3}$ receives the current $I_{32}$ from the circuit 312. The resistor $R_{N3}$ has a negative temperature coefficient. The resistor $R_{P3}$ may be an n-well resistor. The resistor $R_{N3}$ may be a polysilicon resistor.

The voltage across the constant-voltage circuit CV3 is substantially a predetermined constant value. For the purpose of providing a constant voltage, the constant-voltage circuit CV3 may include at least one diode coupled in series, or at least one diode-connected BJT coupled in series, or at least one diode-connected MOSFET coupled in series, or any combination of the elements above. The constant-voltage circuit CV3 in this embodiment comprises only the BJT $Q_3$. The voltage across the constant-voltage circuit CV3 has a negative temperature coefficient.

The current drift problem of the conventional current biasing circuit 200 originates from the fact that the temperature coefficients of the BJT $Q_2$ and the resistor $R_{N2}$ are not balanced. To address this problem, the current biasing circuit 300 introduces the resistor $R_{P3}$ to counteract the temperature-dependent resistance variation of the constant-voltage circuit CV3 and the resistor $R_{N3}$. The following expression can be derived from the fact that the voltage across the circuit 313 is equal to the voltage across the resistor $R_{N3}$.

$$I_{32}=(V_{CV3}+I_{31}*R_{P3})/R_{N3}$$

$V_{CV3}$ is the voltage across the constant-voltage circuit CV3. Similar to the situation of the conventional circuit 200, the temperature coefficient of the constant-voltage circuit CV3 is more negative than that of the resistor $R_{N3}$. The positive temperature coefficient of the resistor $R_{P3}$ helps to stabilize the reference current $I_{32}$. Results of a computer simulation show that there is only a 5% current variance when the temperature varies from −25° C. to 120° C. Compared to the 70% variance of the conventional circuit 100 and the 22% variance of the conventional circuit 200, the 5% variance of the current biasing circuit 300 is much better, making the circuit 300 a substantially temperature-independent current source.

In the current biasing circuit 300, the temperature coefficient of the voltage across the constant-voltage circuit CV3 is more negative than that of the resistance of the resistor $R_{N3}$. Therefore the resistor $R_{P3}$ is introduced to balance the temperature coefficient of the voltage across the constant-voltage circuit CV3. On the other hand, if the temperature coefficient of the resistance of the resistor $R_{N3}$ is more negative than that of the voltage across the constant-voltage circuit CV3, then the resistor $R_{P3}$ has to be moved to be coupled in series with the resistor $R_{N3}$ in order to balance the temperature coefficient of the resistor $R_{N3}$. That is the reason for the next embodiment of the present invention.

Figure 3B:
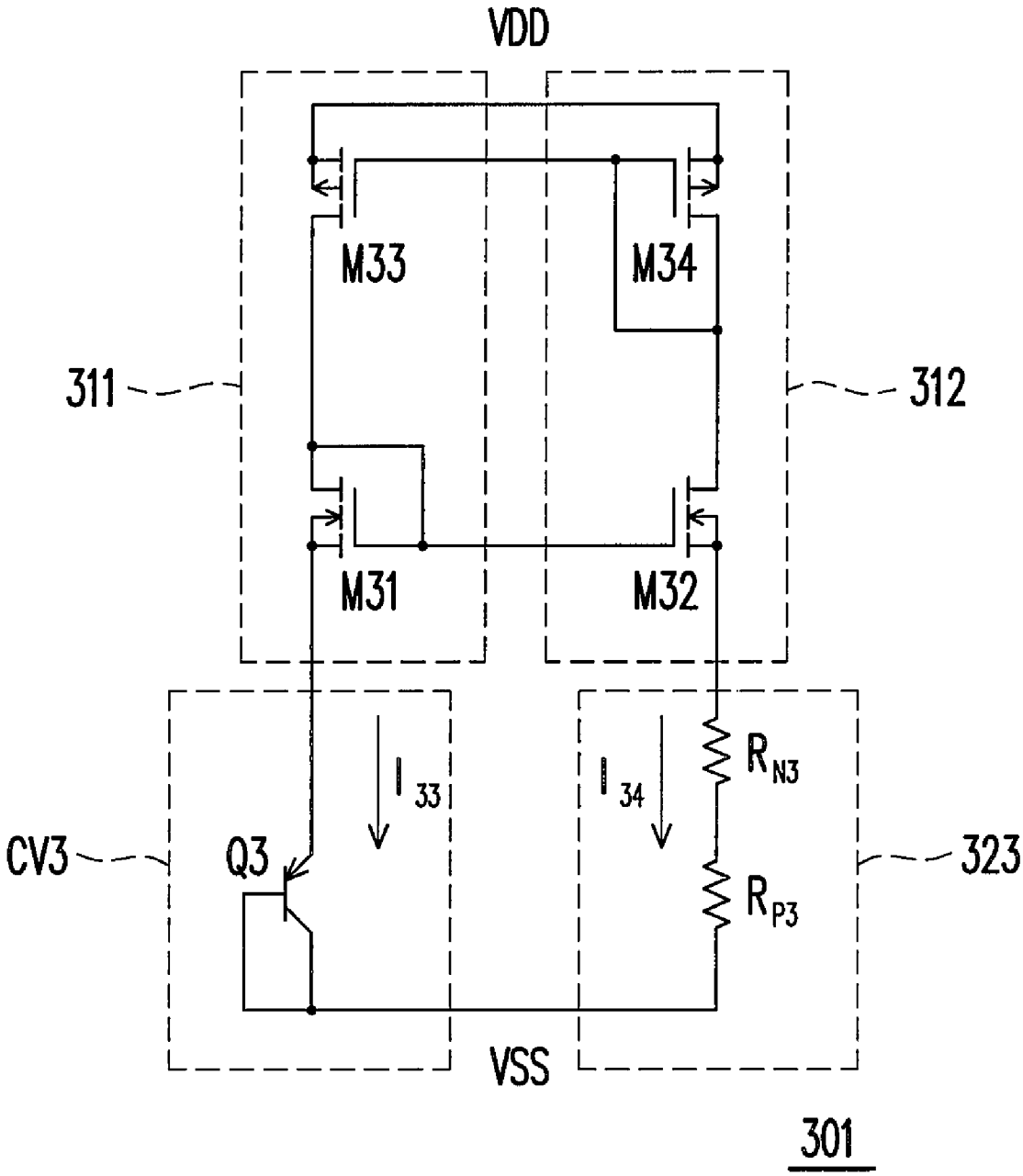

FIG. 3B is a schematic diagram showing the current biasing circuit 301 according to another embodiment of the present invention. The current biasing circuit 301 includes the circuit 311, the circuit 312, the constant-voltage circuit CV3 and the circuit 323. The circuits 311 and 312 are the same as their counterparts in FIG. 3A. The constant-voltage circuit CV3 is coupled between the circuit 311 and the voltage source VSS. The constant-voltage circuit CV3 receives the current $I_{33}$ from the circuit 311. The constant-voltage circuit CV3 is the same as its counterpart in FIG. 3A.

The circuit 323 is coupled between the circuit 312 and the voltage source VSS. The circuit 323 receives the current $I_{34}$ from the circuit 312. The circuit 323 includes the resistor $R_{N3}$ and the resistor $R_{P3}$ coupled in series. The resistor $R_{P3}$ has a positive temperature coefficient, while the resistor $R_{N3}$ has a negative temperature coefficient. The resistor $R_{P3}$ may be an n-well resistor, while the resistor $R_{N3}$ may be a polysilicon resistor.

It is preferable to choose the temperature coefficients of the resistor $R_{P3}$ and the resistor $R_{N3}$ so that the overall temperature coefficient of the circuit 323 is in balance with the temperature coefficient of the constant-voltage circuit CV3, thus making the reference current $I_{34}$ temperature-independent.

Figure 4:
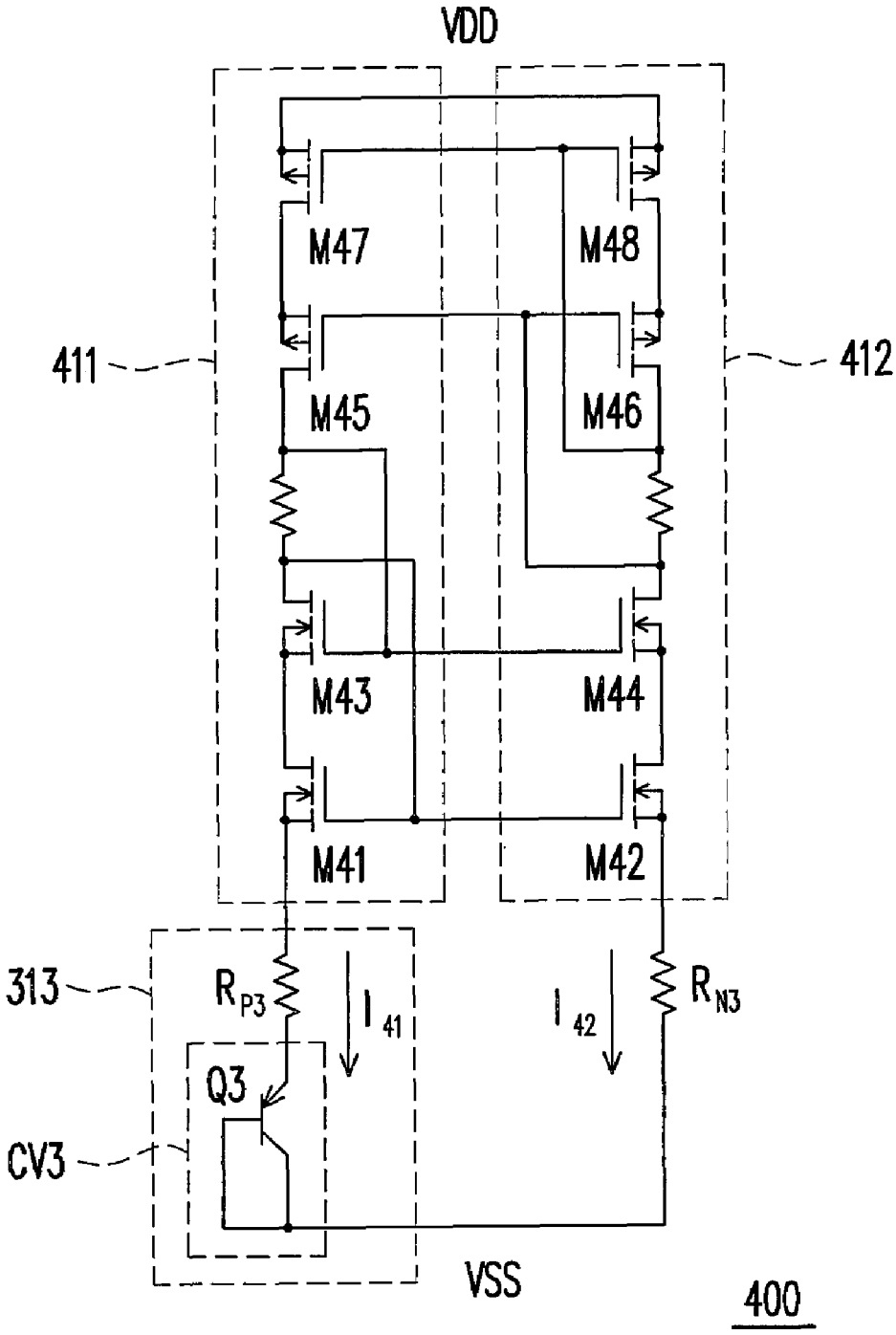

FIG. 4 is a schematic diagram showing the current biasing circuit 400 according to another embodiment of the present invention. The current biasing circuit 400 is an improvement of the current biasing circuit 300 in FIG. 3A by replacing the circuits 311 and 312 with the circuits 411 and 412. The other parts of the current biasing circuit 400, namely the circuit 313 and the resistor $R_{N3}$, are the same as their counterparts in the current biasing circuit 300. The current mirror in the circuit 400 includes eight MOSFETs ($M_{41}$-$M_{48}$) and is therefore more stable than the current mirror in the circuit 300, which includes only four MOSFETs ($M_{31}$-$M_{34}$). In fact, the present invention is not confined to the current mirrors in the previous embodiments. Each current mirror in the previous embodiments may be replaced with any other conventional current mirror.

In summary, the current biasing circuits in the embodiments above are designed to suppress reference current drift caused by temperature variation. The current biasing circuits are easy to implement and are substantially temperature-independent current sources ideal for IC component blocks.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current biasing circuit, comprising:

a first circuit drawing a first current from a first voltage source, wherein the first circuit comprises a plurality of transistors coupled in series;

a second circuit drawing a second current from the first voltage source, wherein the second circuit comprises a plurality of transistors coupled in series, the gate terminal of each transistor of the first circuit is coupled to the gate terminal of one of the transistors of the second circuit, the first current is substantially equal to the second current;

a third circuit, coupled between the first circuit and a second voltage source, receiving the first current from the first circuit, comprising a first resistor and a constant-voltage circuit coupled in series, wherein the first resistor has a positive temperature coefficient, the voltage across the constant-voltage circuit is substantially a predetermined constant value; and a second resistor, coupled between the second circuit and the second voltage source, receiving the second current from the second circuit, wherein the second resistor has a negative temperature coefficient.

2. The current biasing circuit of claim 1, wherein the first resistor is an n-well resistor.

3. The current biasing circuit of claim 1, wherein the second resistor is a polysilicon resistor.

4. The current biasing circuit of claim 1, wherein the constant-voltage circuit comprises a diode.

5. The current biasing circuit of claim 1, wherein the constant-voltage circuit comprises a diode-connected bipolar junction transistor.

6. The current biasing circuit of claim 1, wherein the constant-voltage circuit comprises a diode-connected MOSFET.

7. The current biasing circuit of claim 1, wherein the transistors of the first circuit and the second circuit are bipolar junction transistors.

8. The current biasing circuit of claim 1, wherein the transistors of the first circuit and the second circuit are MOSFETs.

9. The current biasing circuit of claim 1, wherein the first circuit comprises:

a first PMOS transistor coupled to the first voltage source;

a first NMOS transistor coupled between the first PMOS transistor and the third circuit;

and the second circuit comprises:

a second PMOS transistor coupled to the first voltage source;

a second NMOS transistor coupled between the second PMOS transistor and the second resistor;

wherein the first NMOS transistor and the second PMOS transistor are both diode-connected, the gate terminals of the first and second PMOS transistors are coupled, the gate terminals of the first and second NMOS transistors are also coupled.

10. A current biasing circuit, comprising:

a first circuit drawing a first current from a first voltage source, wherein the first circuit comprises a plurality of transistors coupled in series;

a second circuit drawing a second current from the first voltage source, wherein the second circuit comprises a plurality of transistors coupled in series, the gate terminal of each transistor of the first circuit is coupled to the gate terminal of one of the transistors of the second circuit, the first current is substantially equal to the second current;

a constant-voltage circuit, coupled between the first circuit and a second voltage source, receiving the first current from the first circuit, wherein the voltage across the constant-voltage circuit is substantially a predetermined constant value; and a third circuit, coupled to the second circuit and directly connected to the second voltage source, receiving the second current from the second circuit, comprising a first resistor and a second resistor coupled in series, wherein the first resistor has a positive temperature coefficient and the second resistor has a negative temperature coefficient.

11. The current biasing circuit of claim 10, wherein the first resistor is an n-well resistor.

12. The current biasing circuit of claim 10, wherein the second resistor is a polysilicon resistor.

13. The current biasing circuit of claim 10, wherein the constant-voltage circuit comprises a diode.

14. The current biasing circuit of claim 10, wherein the constant-voltage circuit comprises a diode-connected bipolar junction transistor.

15. The current biasing circuit of claim 10, wherein the constant-voltage circuit comprises a diode-connected MOSFET.

16. The current biasing circuit of claim 10, wherein the transistors of the first circuit and the second circuit are bipolar junction transistors.

17. The current biasing circuit of claim 10, wherein the transistors of the first circuit and the second circuit are MOSFETs.

18. The current biasing circuit of claim 10, wherein the first circuit comprises:

a first PMOS transistor coupled to the first voltage source;

a first NMOS transistor coupled between the first PMOS transistor and the constant-voltage circuit;

and the second circuit comprises:

a second PMOS transistor coupled to the first voltage source;

a second NMOS transistor coupled between the second PMOS transistor and the third circuit;

wherein the first NMOS transistor and the second PMOS transistor are both diode-connected, the gate terminals of the first and second PMOS transistors are coupled, the gate terminals of the first and second NMOS transistors are also coupled.

* * * * *